United States Patent [19]

Fogelman

[11] Patent Number: 4,947,526

[45] Date of Patent: Aug. 14, 1990

[54] PLASTIC/METAL TABLE SKIRT CLIP AND METHOD OF MANUFACTURE

[75] Inventor: Sam Fogelman, Chicago, Ill.

[73] Assignee: Midwest Marko, Inc., Chicago, Ill.

[21] Appl. No.: 299,897

[22] Filed: Jan. 23, 1989

[51] Int. Cl.[5] ..... A44B 21/00

[52] U.S. Cl. ..... 24/336; 24/3 L; 108/50

[58] Field of Search ..... 24/336, 3 R, 3 J, 3 L, 24/293, 295, 453, 458; 248/451; 108/50; 403/206

[56] References Cited

U.S. PATENT DOCUMENTS

| | | | |
|---|---|---|---|
| 2,685,720 | 8/1954 | Petri | 403/206 |
| 3,019,954 | 2/1962 | Faltin | 24/336 |
| 3,049,585 | 8/1962 | Cochran | 24/336 |
| 3,171,179 | 3/1965 | Lee | 24/336 |
| 3,231,076 | 1/1966 | Freiman | 24/336 |
| 3,561,066 | 2/1971 | Osteen | 24/3 L |
| 4,017,943 | 4/1977 | Moore | 24/336 |
| 4,056,218 | 11/1977 | Barna | 24/3 R |
| 4,170,181 | 10/1979 | Glasgow | 24/336 |
| 4,360,183 | 11/1982 | Biasini | 248/451 |

FOREIGN PATENT DOCUMENTS

| | | | |
|---|---|---|---|
| 1015998 | 1/1966 | United Kingdom | 24/336 |

*Primary Examiner*—Victor N. Sakran

*Attorney, Agent, or Firm*—Robert E. Browne; Thomas C. McDonough

[57] ABSTRACT

A table skirt clip for securing a table skirt to a table, with a top portion made of clear plastic which is molded to a flexible metal bottom portion. Connecting means formed on the bottom on portion allow secure joinder of the metal and the plastic. This invention has the advantage of a clear plastic top while being adjustable to fit tables of different thicknesses. A method of making a table skirt clip formed of diverse materials, namely a plastic top and a flexible metal bottom, which provides transparency to table top and flexibility for mounting on the table edge.

4 Claims, 1 Drawing Sheet

PLASTIC/METAL TABLE SKIRT CLIP AND METHOD OF MANUFACTURE

BACKGROUND OF THE INVENTION

This invention relates to clips used to hold table skirting to tables and the process used to manufacture these clips. These clips are used in situations where there is a need to temporarily secure a table skirt while it is being used, in a manner so that the clip and skirt can be easily removed when the table is no longer being used. Such skirting is frequently used in restaurants, at banquets, or in other places where a large number are using the tables and it is necessary to quickly set up and disassemble the tables.

Clips for this purpose generally are manufactured from metal or plastic. Plastic clips are not resilient and are breakable and therefore fit only a single thickness of table. Users of plastic clips must therefore stock a different clip for every table they use if the thicknesses of the tables differ. Metal clips generally are adjustable and can be used for more than one thickness of table. However, a major drawback of metal clips is that the metal top is visible against the table cover.

Thus, it would be preferable for a clip to have the advantages of being made of clear plastic so that it is not visible against the table cover while being flexible and resistant to breakage like a metal clip so that it can be adjusted to fit a wide range of table thicknesses.

SUMMARY OF THE INVENTION

This invention combines the advantages of the clear plastic clip with those of the metal clip. The clip in accordance with this invention comprises a clear plastic top portion which is molded with a metal portion. The metal portion is flexible enough to be used on thin tables or expanded for use on thicker tables.

The invention also includes the method of manufacturing the clip described above. The manufacture of the metal part requires the use of new tools to punch very precise holes in a tab portion to allow plastic to be molded onto the tab and through the holes. The metal portion of the clip is designed to be placed in a mold cavity, and held in a position to accommodate direct injection of plastic over its tab, which is held in a second mold cavity. The metal portion must be stamped with a high degree of tolerance and with dimensions appropriate so that its tab will fit in this second mold cavity, which has been designed to mold the plastic over the tab.

The clip uses indicating means, such as dimples, to ensure precise placement of the clip and tab in their respective mold cavities. The plastic is then injected into the second mold cavity and over the tab. This second mold cavity forms the plastic in the shape of the top portion of the clip structure. The plastic used is a special formula of polycarbonate and polyester, designed to provide maximum strength and clearness. This method of manufacture gives a thickness of the plastic which is perfectly equal on both sides of the top of the clip to minimize the plastic part's tendency to fracture or break away from the metal tab.

The resulting table skirt clip has a clear plastic top so it is not readily visible against the table cover, but may be expanded to fit various thicknesses of tables. This invention will be described in more detail in connection with the drawings as follows.

BRIEF DESCRIPTIONS OF THE DRAWINGS

DETAILED DESCRIPTIONS OF THE DRAWINGS

Figure 1:
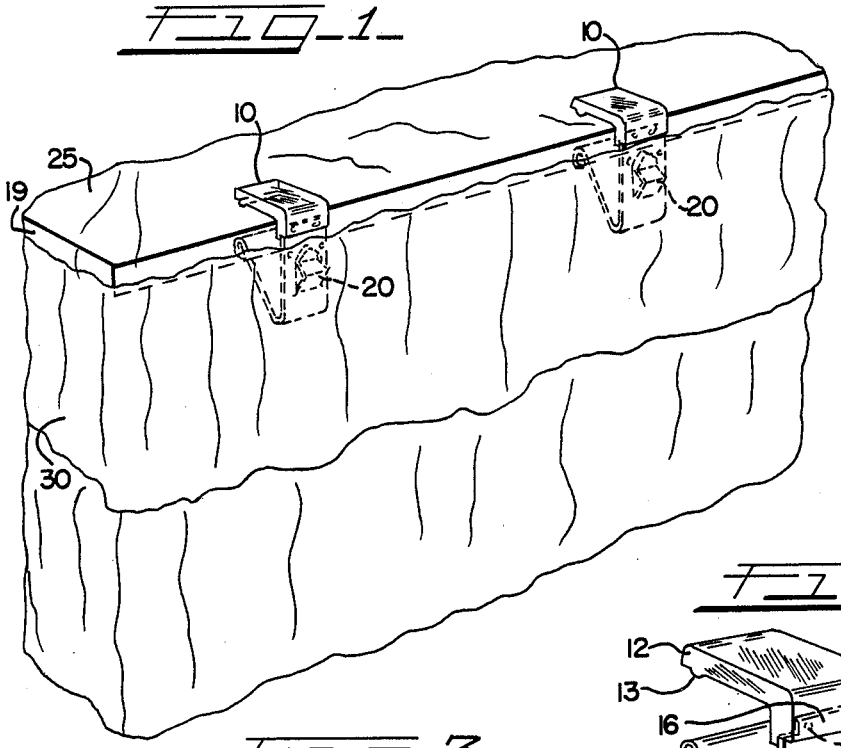
FIG. 1 is a perspective view of the table clip in accordance with the invention as it is used to secure a table skirt to a table.
Figure 2:
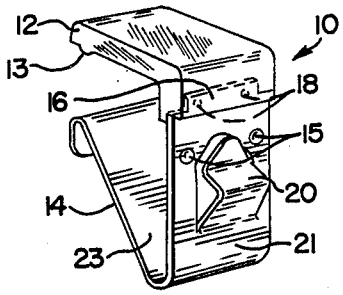
FIG. 2 is a perspective view of the clip.
Figure 3:
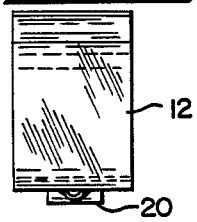
FIG. 3 is a top view of the clip.
Figure 4:
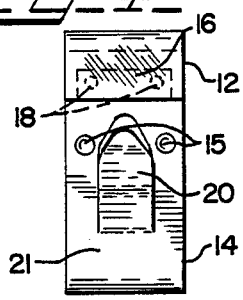
FIG. 4 is an end view of the clip.

FIGS. 1 through 5 disclose a preferred embodiment of this invention. In FIG. 1, one can see this preferred embodiment as it might be used to secure a table skirt to a table. Table clip assemblies 10 are used to secure table skirt 30 to table 19. They also may hold down table cover 25 to the top of the table to prevent it from blowing, etc. Table skirt 30 is shown hanging from an outwardly projecting finger 20 formed in clip 10.

Referring to FIGS. 1 through 4, table clip 10 has clear plastic top 12 molded to tab 16 of metal portion 14, with the plastic molded through holes 18 located on tab 16. Metal portion 14 of clip 10 contains a front face or leg 21 on which are located dimples 15 and skirt clip or finger 20, from which a table skirt 30 may be hung when the clip structure is in use. Skirt 30 has multiple pockets or hangers (not shown) by which it may be hung over finger 20 of clip 10 and thereby attached to the table. Metal portion 14 also contains a resilient bottom face or leg 23 which holds the clip structure 10 against table 19 by pressing against the bottom of table 19. The metal from which metal portion 14 is manufactured is flexible enough to allow the clip to be used on tables of different thicknesses. Clear plastic top 12 has a top face 26 and a bottom face 29. Bottom face 29 has at its outer end a ridge 13 to more securely grip the table top or cover 25 when the clip is in use to prevent it from slipping off.

In manufacturing the table clip 10 of this invention, the metal portion 14 is first stamped or cut from a suitable steel alloy material, as is well known in the art. This metal portion 14 will then have finger 20 cut and bent to the configuration shown in FIG. 2, and bottom leg 23 bent so as to be adjacent to the table bottom when the clip is in use. Unlike the clip shown in our Patent No. D289,972, however, this metal portion 14 is formed with tab 16 at the top of front face or leg 21.

Figure 5:
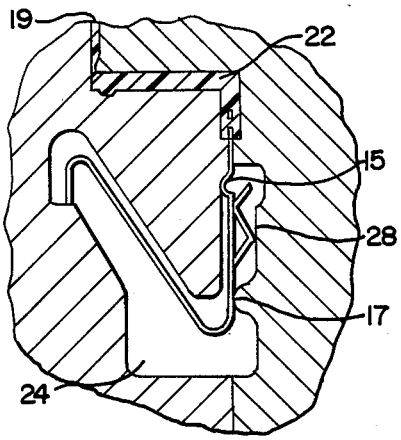
FIG. 5 is a side view of the clip as it is placed in the mold designed to accept the injection of plastic directly over the top of the metal portion.

Referring to FIG. 5, a mold 50 is used to join the plastic portion and metal portion of the clip structure. Metal portion 14 of clip 10 is inserted and held in position in a first mold cavity 24 in mold 50 so that tab 16 is precisely inserted into second mold cavity 22. Plastic is injected into second mold cavity 22 through mold entrance 19 to form plastic top 12 around tab 16. The plastic flows through holes 18 formed in tab 16 to secure plastic top 12 to metal portion 14.

The metal clip portion 14 has dimples 15 formed below tabe 16 for the purpose of registering the tab 16 in its proper position in the mold 50. These dimples 15 act to contact the outside of the jaw of first mold cavity 24 and act as registering means to bring metal portion 14 into the proper position. Inner wall 28 of first mold cavity area 24 contains a protrusion 17, which contacts the front face 21 of metal portion 14 to support metal portion 14 in the first mold cavity 24. This assures that the tab 16 is level and the plastic molded will be symmetrical or equidistant above and below the horizontal axis of tab 16. Dimples 15 and protrusion 17 therefore allow precise and symmetrical molding of the plastic over tab 16. This is critical in order to reduce stresses in the plastic and to assure proper joinder at the metal-plastic interface.

It is to be understood that the above descriptions are not intended to limit the scope of the invention in any way. Various modifications and equivalents will be obvious to one skilled in the art. This invention should be read as limited by its claims only.

I claim:

1. A table skirt clip used for fastening a table skirt to a table, comprising a bottom portion composed of a flexible metal, and a top portion composed of a transparent plastic and being positionably adjusted on top of said table, said top portion being fixedly joined to said bottom portion, said top portion allowing viewing of the top of said table therethrough; said bottom portion having a front leg for positioning adjacent to a front edge of said table, a flexible bottom leg for positioning adjacent to a bottom of said table for mounting said clip thereon; and a connecting means located on and integrally formed with said bottom portion; said connecting means having at least one opening formed therein to receive an injection of said transparent plastic therethrough so as to secure said plastic top portion to said connecting means and said bottom portion.

2. A table skirt clip in accordance with claim 1, wherein said bottom portion has indicating means formed therein for locating said bottom portion relative to said top portion for use during the joinder of said top portion to said bottom portion.

3. A table skirt clip in accordance with claim 2, wherein said front leg of said bottom portion contains a fastener means integrally formed therewith, said fastener means formed to engage said table skirt.

4. A table skirt clip in accordance with claim 2, in which said top portion has gripping means formed in an outer end thereof.

* * * * *